US007699591B2

(12) United States Patent
Futagami et al.

(10) Patent No.: US 7,699,591 B2
(45) Date of Patent: Apr. 20, 2010

(54) SCROLL COMPRESSOR WITH SURFACE PROCESSED ORBITING SCROLL PLATE BACK SURFACE

(75) Inventors: Yoshiyuki Futagami, Shiga (JP); Noboru Iida, Shiga (JP); Akira Hiwata, Kyoto (JP); Hidenobu Shintaku, Shiga (JP)

(73) Assignee: Matsushita Electric Industrial Co., Ltd., Kadoma-shi (JP)

( * ) Notice: Subject to any disclaimer, the term of this patent is extended or adjusted under 35 U.S.C. 154(b) by 221 days.

(21) Appl. No.: 10/561,963

(22) PCT Filed: Jun. 22, 2004

(86) PCT No.: PCT/JP2004/009082

§ 371 (c)(1),
(2), (4) Date: Mar. 27, 2007

(87) PCT Pub. No.: WO2004/113730

PCT Pub. Date: Dec. 29, 2004

(65) Prior Publication Data

US 2007/0212244 A1 Sep. 13, 2007

(30) Foreign Application Priority Data

Jun. 24, 2003 (JP) ..... 2003-179186

(51) Int. Cl.
*F01C 21/00* (2006.01)
*F03C 2/00* (2006.01)

(52) U.S. Cl. ..... 418/178; 418/55.2; 418/55.5; 418/57; 418/179

(58) Field of Classification Search ..... 418/55.1–55.6, 418/57, 1, 178, 179
See application file for complete search history.

(56) References Cited

U.S. PATENT DOCUMENTS 5,468,130 A * 11/1995 Yamada et al. ..... 418/55.2
5,573,390 A * 11/1996 Takeuchi et al. ..... 418/178
5,584,678 A * 12/1996 Hirooka et al. ..... 418/55.2
6,302,665 B1 * 10/2001 Esumi et al. ..... 418/178

FOREIGN PATENT DOCUMENTS

JP 63-289280 11/1988
JP 6-317271 11/1994
JP 06-317271 11/1994
JP 08-049671 2/1996
JP 8-49671 2/1996
JP 08144980 A * 6/1996
JP 10-110687 4/1998
JP 2001280252 A * 10/2001

OTHER PUBLICATIONS

Chinese Office Action dated Aug. 17, 2007.
Japanese Office Action mailed Apr. 28, 2009 with English translation (5 pages).

* cited by examiner

*Primary Examiner*—Theresa Trieu
(74) *Attorney, Agent, or Firm*—Kratz, Quintos & Hanson, LLP

(57) ABSTRACT

A scroll compressor in which a scroll fixed lap rising from a fixed plate of a fixed scroll and a scroll orbiting lap rising from an orbiting plate of an orbiting scroll are combined with each other to form compression chambers therebetween, the fixed scroll is made of iron-based material, the orbiting scroll is made of aluminum-based material, at least the plate back surface of the orbiting scroll is subjected to surface processing.

4 Claims, 3 Drawing Sheets

PRIOR ART

SCROLL COMPRESSOR WITH SURFACE PROCESSED ORBITING SCROLL PLATE BACK SURFACE

TECHNICAL FIELD

The present invention relates to a scroll compressor used for a cooling apparatus such as an air conditioner and a refrigerator.

BACKGROUND TECHNIQUE

As a refrigeration air conditioning hermetic compressor, there are conventional reciprocating type, rotary type and scroll type compressors, and these compressors are used in refrigeration or air conditioning fields of domestic or business purpose. Currently, compressors are developed while utilizing characteristics in terms of costs and performance.

Among them, a so-called hermetical compressor for preventing noise and eliminating the need of maintenance is a typical compressor in which a compressor mechanism and a motor are accommodated in a container, and a scroll compressor and a rotary compressor are in the mainstream. Generally, in the scroll compressor, a fixed scroll in which a scroll lap rises from a plate and an orbiting scroll are combined with each other to form a compression chamber therebetween, when the orbiting scroll is allowed to orbit in a circular orbit while restraining the orbiting scroll from rotating by a rotation-restraint mechanism, a compression chamber moves while changing its volume, thereby carrying out the suction, compression and discharge, a predetermined back pressure is applied to an outer periphery of the orbiting scroll and a back surface of a lap by lubricant oil, so that the orbiting scroll is not separated from the fixed scroll and does not flip over.

FIG. 4 shows the conventional scroll compressor (e.g., patent document 1). FIG. 4 is a sectional view of the conventional scroll compressor. Refrigerant gas sucked into the suction pipe 1 passes through the suction space 3 of the fixed scroll 2 comprising the lap 2*a* and the plate 2*b*, and is enclosed in the compression chamber 5 formed by meshing the fixed scroll 2 with the orbiting scroll 4 comprising the lap 4*a* and the plate 4*b*, the refrigerant gas is compressed while reducing the volume thereof toward the center of the fixed scroll 2, and is discharged from the discharge port 6.

A back pressure space 8*a* is formed such as to be surrounded by the orbiting scroll 4 and a seal ring 14 mounted in a ring-like groove of a frame 7. The pressure in the back pressure space 8*a* is set to an intermediate pressure between discharge pressure and suction pressure, and the intermediate pressure is controlled such that this pressure becomes constant by a back pressure adjusting mechanism 9. The seal ring 14 slides with a plate back surface 4*c* of the orbiting scroll 4.

The back pressure adjusting mechanism 9 has a connecting channel 10 which is in connection with a suction space 3 through the fixed scroll 2 from the back pressure space 8*a*, and the connecting channel 10 is provided with a valve 11. If the pressure in the back pressure space 8*a* becomes higher than a set pressure, the valve 11 is opened, oil in the back pressure space 8*a* is supplied to the suction space 3, and the pressure in the back pressure space 8*a* is maintained at a constant intermediate pressure. The oil supplied to the suction space 3 moves to the compression chambers 5 together with the orbiting motion, and this prevents oil from leaking between the compression chambers 5. The intermediate pressure is applied to a back surface of the orbiting scroll 4 to prevent the scroll compressor from flipping over. If the scroll compressor flips over, the fixed scroll 2 and the orbiting scroll 4 are separated, and oil leaks from that portion.

Iron-based material mainly comprising cast iron is used for the fixed scroll 2 and the orbiting scroll 4 which constitute the scroll compressor, or iron-based material is used for the fixed scroll 2 and aluminum-based material is used for the orbiting scroll 4.

(Patent Document 1)

Japanese Patent Application Laid-open No. 2001-280252

In the above structure, however, when the scroll compressor is started at a low temperature or when a large amount of liquid returns to a suction port during defrosting operation of the cycle, in order to compress liquid refrigerant, the pressure in the compression chamber 5 abnormally rises, and the orbiting scroll 4 and the fixed scroll 2 are adversely separated from each other. At that time, the plate back surface 4*c* of the orbiting scroll 4 abuts against a flat surface 15 of the frame 7, and there is a problem that seizing is generated.

The present invention has been accomplished to solve such a conventional problem, and it is an object of the invention to provide a reliable scroll compressor.

DISCLOSURE OF THE INVENTION

A first aspect of the present invention provides a scroll compressor in which a scroll fixed lap rising from a fixed plate of a fixed scroll and a scroll orbiting lap rising from an orbiting plate of an orbiting scroll are combined with each other to form compression chambers therebetween, a plate back surface of the orbiting scroll is provided with a back pressure space, the back pressure space is divided into an inner region and an outer region by a seal ring, high pressure is applied to the inner region of the seal ring, pressure which is lower than that applied to the inner region is applied to the outer region, thereby bringing the orbiting scroll into contact with the fixed scroll, a rotation-restraint restrains the orbiting scroll from rotating, the orbiting scroll is allowed to orbit, thereby moving the compression chamber toward a center of scroll while reducing volume of the compression chamber, refrigerant gas is sucked into the compression chamber and compressed, wherein the fixed scroll is made of iron-based material, the orbiting scroll is made of aluminum-based material, at least the plate back surface of the orbiting scroll is subjected to surface processing. When the scroll compressor is started at a low temperature or when a large amount of liquid returns to a suction port during defrosting operation of the cycle, in order to compress liquid refrigerant, the pressure in the compression chamber abnormally rises, and the orbiting scroll and the fixed scroll are adversely separated from each other.

According to this aspect, even if the plate back surface of the orbiting scroll is pushed against a flat surface of a frame, seizing is not generated due to a hardened layer formed by the surface processing, and a reliable scroll compressor can be obtained.

According to a second aspect of the invention, in the scroll compressor of the first aspect, any of alumite coating processing, PVD processing and nickel phosphorus plating processing is carried out as the surface processing.

With this aspect, even if the plate back surface slides with the flat surface of the frame, wear of the film having the hardened layer is small, the film formed by the surface processing remains even if the scroll compressor is used for a long time, seizing is not generated and the reliability of the scroll compressor is enhanced.

According to a third aspect of the invention, in the scroll compressor of the first or second aspect, at least a sliding portion between the plate back surface and the seal ring is subjected to lapping processing, buff processing or barrel polishing processing after the surface processing.

With this aspect, the roughness caused by the surface processing is made small. Thus, the friction resistance between the seal ring and the plate back surface of the orbiting scroll is reduced, the reliability of the seal ring with respect to the plate back surface of the orbiting scroll is enhanced, the sliding loss is reduced, and the performance is enhanced.

According to a fourth aspect of the invention, in the scroll compressor of the first or second aspect, the sliding portion between the plate back surface and the seal ring is masked and subjected to the surface processing.

With this aspect, the hardened layer formed by the surface processing does not wear the seal ring, and it is possible to provide a reliable scroll compressor.

According to a fifth aspect of the invention, in the scroll compressor of the first or second aspect, the surface processing of the sliding portion between the plate back surface and the seal ring is removed by working.

With this aspect, a jig is not required at the time of masking, and the cost can be reduced.

BEST MODE FOR CARRYING OUT THE INVENTION

An embodiment of the present invention will be explained with reference to the drawings.

Figure 1:
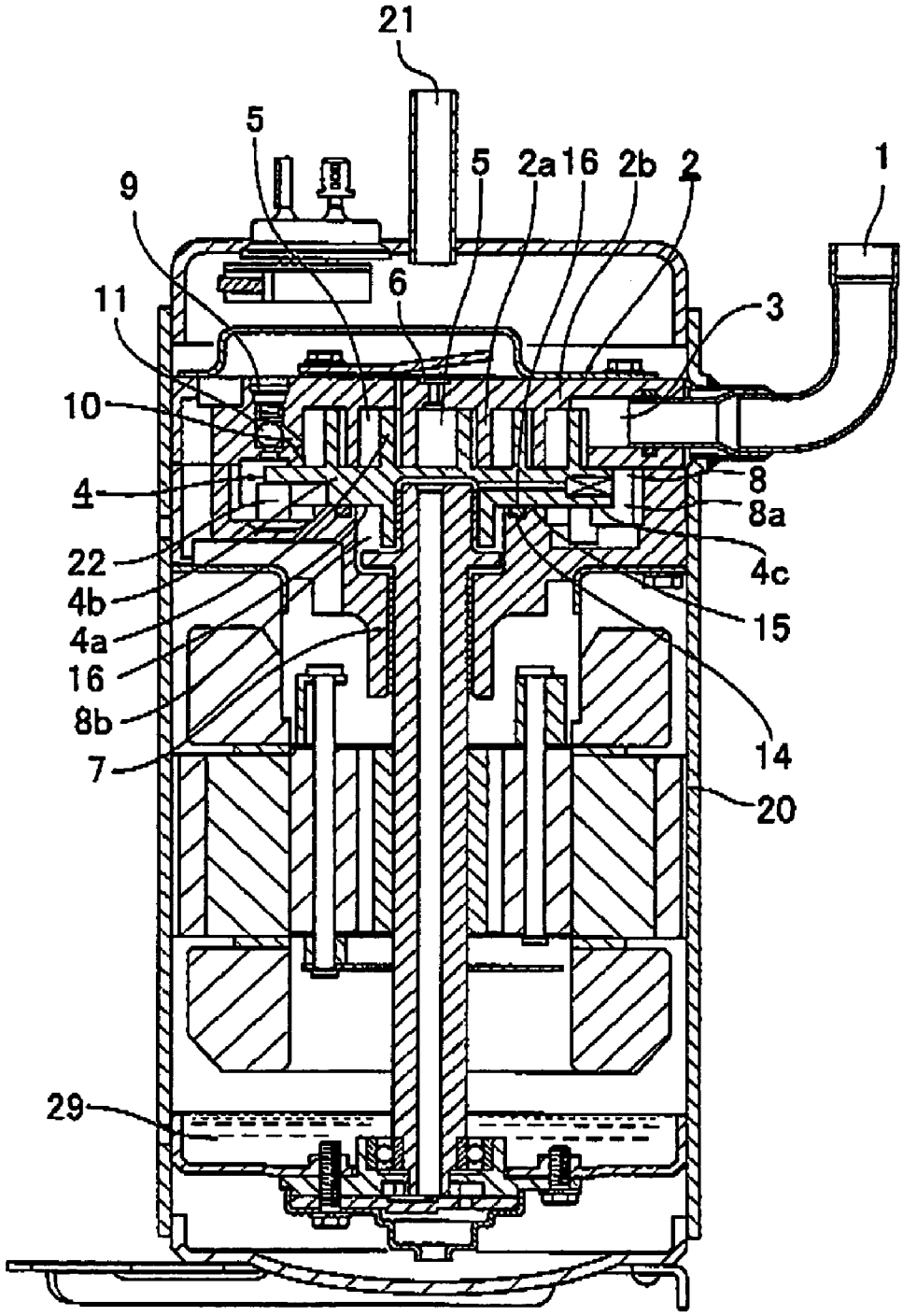
FIG. 1 is a vertical sectional view showing a scroll compressor of an embodiment of the present invention.
Figure 2:
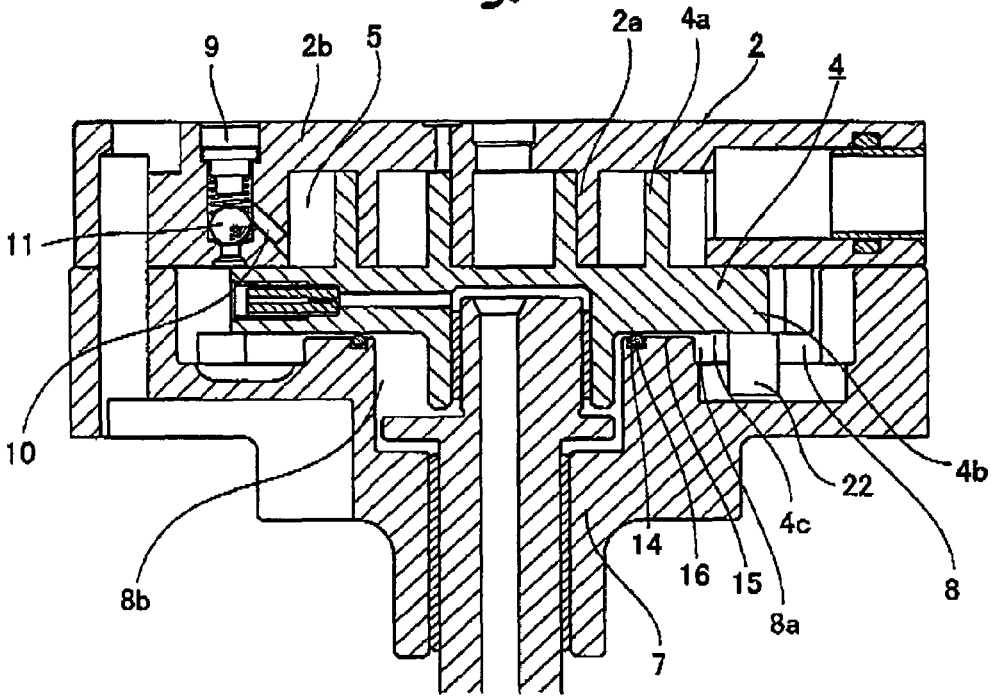
FIG. 2 is a sectional view of an essential portion of the scroll compressor.
Figure 3:
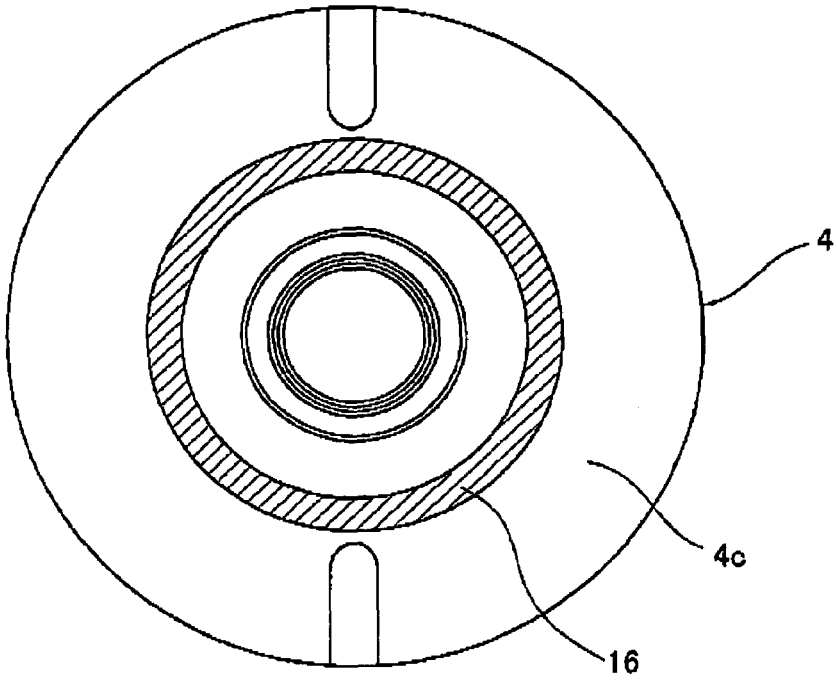
FIG. 3 is a plan view of a plate back surface of an orbiting scroll used in the scroll compressor.
Figure 4:
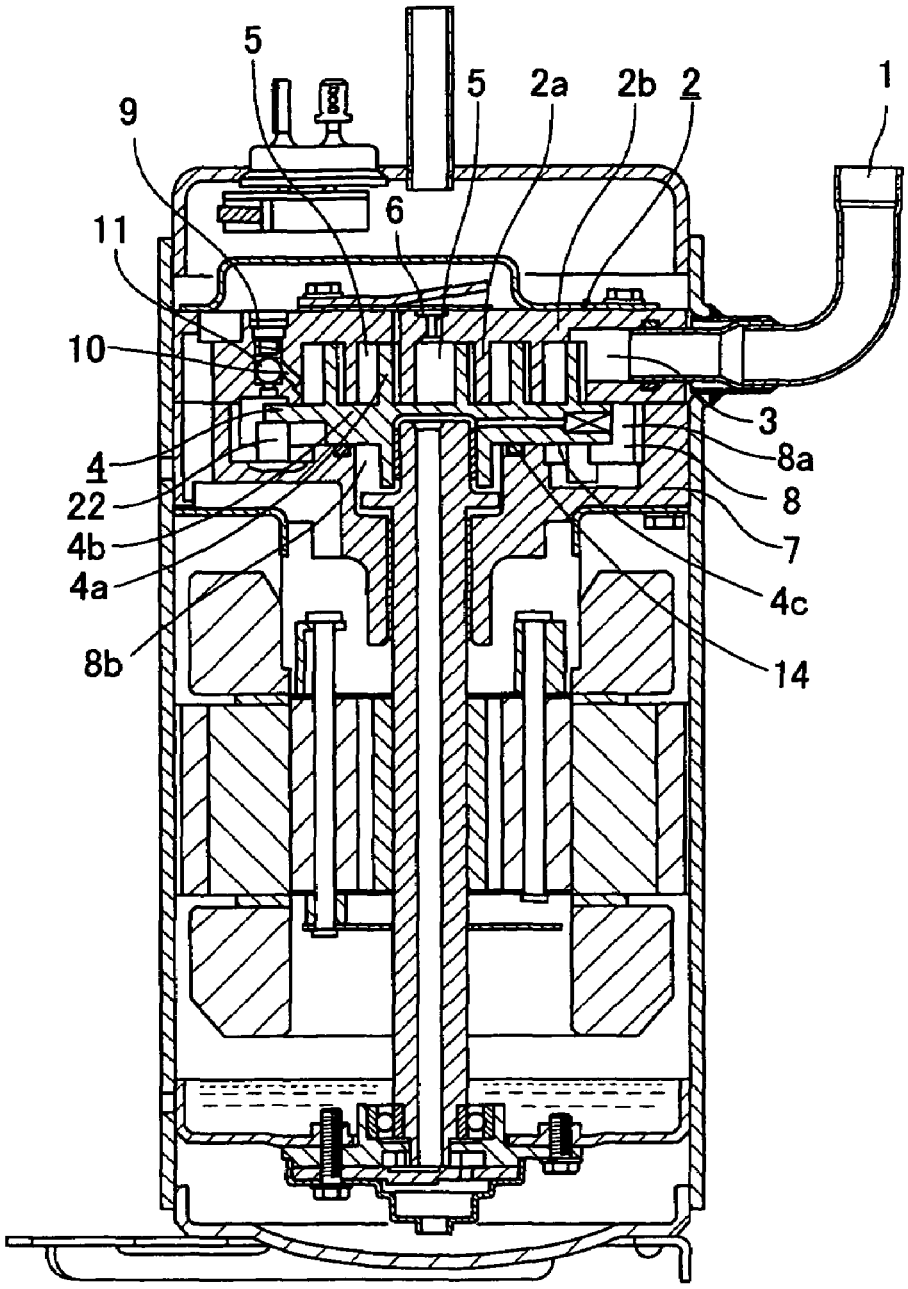
FIG. 4 is a vertical sectional view of a conventional scroll compressor.

FIG. 1 is a sectional view showing a scroll compressor of an embodiment of the invention. FIG. 2 is a sectional view of an essential portion of the scroll compressor. FIG. 3 is a plan view of a plate back surface of an orbiting scroll used in the scroll compressor. The same members as those of the conventional scroll compressor shown in FIG. 4 are designated with the same symbols.

The scroll compressor of the embodiment includes a compressor mechanism and a motor mechanism in a container 20. The compressor mechanism is disposed at an upper portion in the container 20, and the motor mechanism is disposed below the compressor mechanism. The container 20 is provided at its upper portion with a suction pipe 1 and a discharge pipe 21. An oil reservoir 29 for accumulating lubricant oil is provided at a lower portion in the container 20.

The compressor mechanism includes a fixed scroll 2 and an orbiting scroll 4. The fixed scroll 2 and the orbiting scroll 4 are combined with each other to form a plurality of compression chambers 5. The fixed scroll 2 has a fixed scroll lap 2*a* (scroll lap 2*a*, hereinafter) rising from a fixed plate 2*b* (mirror plate 2*b*, hereinafter), and the orbiting scroll 4 has an orbiting scroll lap 4*a* (scroll lap 4*a*, hereinafter) rising from an orbiting plate 4*b* (mirror plate 4*b*, hereinafter). The compression chambers 5 are formed between the plate 2*b* and the plate 4*b* by meshing the lap 2*a* and the lap 4*a* with each other.

The orbiting scroll 4 is restrained from rotating by a rotation-restraint mechanism 22, and the orbiting scroll 4 orbits in a circular orbit. The compression chamber 5 moves while varying its volume by orbiting motion of the orbiting scroll 4.

The plate back surface 4*c* of the orbiting scroll 4 is provided with a back pressure space 8. In the back pressure space 8, a seal ring 14 is disposed in a circular groove provided in the frame 7. The back pressure space 8 is divided by the seal ring 14 into two spaces, i.e., an outer region 8*a* and an inner region 8*b*. High discharge pressure is applied to the inner region 8*b*. Predetermined intermediate pressure from suction pressure to discharge pressure is applied to the outer region 8*a*. Thrust force is applied to the orbiting scroll 4 by pressure in the back pressure space 8, the orbiting scroll 4 is stably pushed against the fixed scroll 2, thereby reducing the leakage, and the orbiting scroll 4 stably orbits.

According to the scroll compressor of the embodiment, the fixed scroll 2 is made of iron-based material, the orbiting scroll 4 is made of aluminum-based material, the plate back surface 4*c* is subjected to surface processing and a hardened layer is formed thereon. Any of alumite coating processing, PVD processing and nickel phosphorus plating processing is carried out as the surface processing.

When the scroll compressor is started at a low temperature or when a large amount of liquid returns to a suction port during defrosting operation of the cycle, in order to compress liquid refrigerant, the pressure in the compression chamber abnormally rises, and the orbiting scroll 4 and the fixed scroll 2 are adversely separated from each other. At that time, the plate back surface 4*c* of the orbiting scroll 4 abuts against the flat surface 15 of the frame 7. However, seizing or abnormal wearing is not generated due to the hardened layer formed by the surface processing, and the hardened layer remains although the scroll compressor is used for a long time, and a reliable scroll compressor can be obtained.

The sliding portion 16 with respect to the seal ring 14 of the plate back surface 4*c* of the orbiting scroll 4 is subjected to lapping processing, buff processing or barrel polishing processing after surface processing. This is because when roughness caused by the surface processing is large, if the seal ring 14 and the plate back surface 4*c* of the orbiting scroll 4 slide with each other, the lapping processing, buff processing or barrel polishing processing prevents the seal ring 14 having low hardness from being bent or damaged. By making the roughness caused by the surface processing small by the lapping processing, buff processing or barrel polishing processing after surface processing, it is possible to reduce the friction resistance between the seal ring 14 and the plate back surface 4*c* of the orbiting scroll 4, enhance the reliability of the seal ring 14 and the plate back surface 4*c* of the orbiting scroll 4, and to reduce the sliding loss at the sliding portion 16, thereby enhancing the performance.

If the sliding portion 16 between the seal ring 14 and the plate back surface 4*c* of the orbiting scroll 4 is masked and the surface processing is carried out, it is possible to obtain the same effect even when the hardened layer of surface processing is not provided only on the sliding portion 16 between the seal ring 14 and the plate back surface 4*c* of the orbiting scroll 4.

Further, the same effect can be obtained even if the surface processing carried out for the sliding portion 16 between the seal ring 14 and the plate back surface 4*c* of the orbiting scroll 4 is removed by working.

As apparent from the above embodiment, according to the present invention, the fixed scroll is made of iron-based material, the orbiting scroll is made of aluminum-based material, and at least the plate back surface is subjected to the surface processing. With this, even if the plate back surface of the orbiting scroll is pushed against the flat surface of the frame, no seizing is generated due to the hardened layer formed by the surface processing, and a reliable scroll compressor can be obtained.

According to the present invention, any of alumite coating processing, PVD processing and nickel phosphorus plating processing is carried out as the surface processing. Therefore, even if the surface slides with the flat surface of the frame, the wear of the film having the hardened layer is small, the surface processing film remains although the scroll compressor is used for a long time, no seizing is generated, and reliability can be enhanced.

According to the present invention, the sliding portion at least with respect to the seal ring of the plate back surface is subjected to the lapping processing, buff processing or barrel polishing processing after surface processing, thereby making the roughness caused by the surface processing small. With this, the friction resistance between the seal ring and the plate back surface of the orbiting scroll is reduced, the reliability of the seal ring with respect to the plate back surface of the orbiting scroll is enhanced, the sliding loss is reduced, and the performance is enhanced.

According to the present invention, the sliding portion between the seal ring and the plate back surface is masked and subjected to the surface processing. Therefore, the hardened layer formed by the surface processing does not wear the seal ring, and it is possible to provide a reliable scroll compressor.

According to the present invention, the surface processing of the suction pressure between the plate back surface and the seal ring is removed by working. Therefore, a part is not required at the time of masking, and the cost can be reduced.

INDUSTRIAL APPLICABILITY

The scroll compressor of the present invention is used for a cooling apparatus such as an air conditioner and a refrigerator of domestic or business purpose.

The invention claimed is:

1. A scroll compressor in which a scroll fixed lap rising from a fixed plate of a fixed scroll and a scroll orbiting lap rising from an orbit ng plate of an orbiting scroll are combined with each other to form compression chambers therebetween, a plate back surface of said orbiting scroll is provided with a back pressure space, said back pressure space is divided into an inner region and an outer region by a seal ring, high pressure is applied to said inner region of said seal ring, pressure which is lower than that applied to said in tier region is applied to said outer region, thereby bringing said orbiting scroll into contact with said fixed scroll, a rotation-resistant part restrains said orbiting scroll from rotating, said orbiting scroll is allowed to orbit, thereby moving said compression chamber toward a center of scroll while reducing volume of said compression chamber, refrigerant gas is sucked into said compression chamber and compressed, wherein;

said seal ring is located in said back pressure space, said fixed scroll is made of iron-based material, said orbiting scroll is made of aluminum-based material, only said plate back surface of said orbiting scroll is subjected to surface processing to form a hardened layer, and a sliding portion between said plate back surface of said orbiting scroll and said seal ring is masked and subjected to the surface processing, so as to provide reduced friction between the seal ring and the place back surface, thereby forming said hardened layer on a portion of said plate back surface, but not forming said hardened layer on the sliding portion between said back plate surface and said seal ring.

2. The scroll compressor according to claim 1, wherein any of alumite coating processing, PVD processing and nickel phosphorus plating processing is carried out as the surface processing.

3. A scroll compressor in which a scroll fixed lap rising from a fixed plate of a fixed scroll and a scroll orbiting lap rising from an orbiting plate of an orbiting scroll are combined with each other to form compression chambers therebetween, a plate back surface of said orbiting scroll is provided with a back pressure space, said back pressure space is divided into an inner region and an outer region by a seal ring, high pressure is applied to said inner region of said seal ring, pressure which is lower than that applied to said inner region is applied to said outer region, thereby bringing said orbiting scroll into contact with said fixed scroll, a rotation resistant parts restrains said orbiting scroll from rotating, said orbiting scroll is allowed to orbit, thereby moving said compression chamber toward a center of scroll while reducing volume of said compression chamber, refrigerant gas is sucked into said compression chamber and compressed, wherein:

said seal ring is located in said back pressure space, said fixed scroll is made of iron-based material, said orbiting scroll is made of aluminum-based material, only said plate back surface of said orbiting scroll is subjected to surface processing to form a hardened layer, and said hardened layer formed by the surface processing of a sliding portion between said plate back surface of said orbiting scroll and said seal ring only, is removed by working, so as to provide reduced friction between the seal ring and the plate back surface.

4. The scroll compressor according to claim 3, wherein any of alumite coating processing, PVD processing and nickel phosphorus plating processing is carried out as the surface processing.

* * * * *